US006520330B1

(12) United States Patent
Batra

(10) Patent No.: US 6,520,330 B1
(45) Date of Patent: Feb. 18, 2003

(54) PACKAGE AND CONSUMER PRODUCTS THEREIN HAVING MATCHED INDICIA

(75) Inventor: Anjana Batra, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 52 days.

(21) Appl. No.: 09/345,857

(22) Filed: Jul. 1, 1999

(51) Int. Cl.[7] ..... B65D 85/00; B65D 73/00
(52) U.S. Cl. ..... 206/494; 206/459.5
(58) Field of Search ..... 206/457, 459.5, 206/494, 812

(56) References Cited

U.S. PATENT DOCUMENTS

| | | | | | |
|---|---|---|---|---|---|
| D7,031 | S | | 12/1873 | Horan | |
| 298,133 | A | * | 5/1884 | Swinscoe | 206/459.5 X |
| 1,142,020 | A | * | 6/1915 | Carver | 206/459.5 X |
| D64,690 | S | | 5/1924 | Schwarz | |
| 1,611,403 | A | * | 12/1926 | Bales | 206/459.5 X |
| 1,784,952 | A | * | 12/1930 | Wolfson | 206/459.5 X |
| 1,922,969 | A | * | 8/1933 | MacColl | 206/459.5 X |
| 1,957,256 | A | * | 5/1934 | Frey | 206/457 X |
| 2,011,179 | A | * | 8/1935 | Krout | 206/459.5 X |
| 2,032,717 | A | * | 3/1936 | Reinhold | 206/459.5 X |
| 2,082,671 | A | * | 6/1937 | Walker | 206/457 X |
| 2,128,658 | A | * | 8/1938 | Millett | 206/459.5 X |
| D126,826 | S | * | 4/1941 | Lane | 206/457 X |
| 2,383,637 | A | * | 8/1945 | Yates et al. | 206/459.5 X |
| 2,433,663 | A | * | 12/1947 | Hanson | 206/459.5 X |
| D149,874 | S | * | 6/1948 | Hay | 206/457 X |
| D239,137 | S | | 3/1976 | Appleman | |
| D259,219 | S | | 5/1981 | Bates et al. | |
| 4,546,881 | A | * | 10/1985 | Tasma | 206/459.5 X |
| 4,623,074 | A | | 11/1986 | Dearwester | |
| D319,349 | S | | 8/1991 | Schultz et al. | |
| 5,123,566 | A | | 6/1992 | Lage et al. | |
| D341,490 | S | | 11/1993 | Curran et al. | |
| D352,833 | S | | 11/1994 | Schulz | |
| D354,853 | S | | 1/1995 | Schulz | |
| D354,854 | S | | 1/1995 | Schulz | |
| D354,855 | S | | 1/1995 | Schulz | |
| D354,856 | S | | 1/1995 | Schulz | |
| D361,895 | S | | 9/1995 | Arnone et al. | |
| D362,967 | S | | 10/1995 | Rothwell et al. | |
| D363,610 | S | | 10/1995 | Saffran et al. | |
| D367,764 | S | | 3/1996 | Makoui et al. | |
| D367,765 | S | | 3/1996 | Makoui et al. | |
| D367,766 | S | | 3/1996 | Makoui et al. | |
| D368,587 | S | | 4/1996 | Schulz | |
| D371,910 | S | | 7/1996 | Schulz | |
| D372,589 | S | | 8/1996 | Burgess et al. | |
| D373,026 | S | | 8/1996 | Delebreau et al. | |
| D373,905 | S | | 9/1996 | Schulz | |
| D375,633 | S | | 11/1996 | Spanagel et al. | |
| D375,844 | S | | 11/1996 | Edwards et al. | |
| D377,419 | S | | 1/1997 | Schulz | |
| D378,875 | S | | 4/1997 | Miller et al. | |
| D378,876 | S | | 4/1997 | Spanagel et al. | |
| D381,811 | S | | 8/1997 | du Grosriez | |
| D382,118 | S | | 8/1997 | Ferrero | |
| D382,119 | S | | 8/1997 | Ferrero | |
| D382,162 | S | | 8/1997 | Ertolacci et al. | |
| D382,713 | S | | 8/1997 | Giesler, Sr. | |
| D383,003 | S | | 9/1997 | Hepford | |
| D384,210 | S | | 9/1997 | du Grosriez | |
| 5,673,796 | A | * | 10/1997 | Tulloch | 206/459.5 X |
| D390,362 | S | | 2/1998 | Baum et al. | |
| D390,363 | S | | 2/1998 | Baum et al. | |
| D392,108 | S | | 3/1998 | Diggins et al. | |
| D399,062 | S | | 10/1998 | Sporing | |
| 5,820,730 | A | | 10/1998 | Phan et al. | |
| D400,716 | S | | 11/1998 | Sporing et al. | |
| D401,420 | S | | 11/1998 | Sporing et al. | |
| 5,874,156 | A | | 2/1999 | Schulz | |
| D409,389 | S | | 5/1999 | May et al. | |

* cited by examiner

*Primary Examiner*—Bryon P. Gehman
(74) *Attorney, Agent, or Firm*—Larry L. Huston; David K. Mattheis; David M. Weirich

(57) ABSTRACT

Consumer products dispensable from a package. The consumer product and package each have decorative, aesthetically pleasing indicia. The indicia on the package and consumer product are matched. The indicia preferably comprise a latticework with decorative markings in the cells of the latticework. The invention is particularly applicable to sheet goods such as facial tissue, paper toweling, bath tissue, napkins, etc.

18 Claims, 14 Drawing Sheets

PACKAGE AND CONSUMER PRODUCTS THEREIN HAVING MATCHED INDICIA

FIELD OF THE INVENTION

This invention relates to consumer products disposed in and dispensed from a package, and more particularly to such consumer products and packages having matched indicia which may identify the package and products as being sold together or otherwise related.

BACKGROUND OF THE INVENTION

Disposable consumer products and packages containing such products are well known in the art. Such products may include, for example, facial tissues, salted snacks, paper toweling, bar soap, hankies, bath tissue, napkins, placemats, paper plates, chocolates, candies, etc.

Frequently, identifying indicia are provided on the outside of the packaging for such products. Such indicia may include, for example, trademarks, trade dress features, instructions for use, advertising for flank or related products, etc.

Likewise, decorative and identifying indicia may be applied to the products contained in the package. For example, the trademark may appear on both the package and the product as, occurs, for example, in the case of chocolate candy, bar soap, paper toweling, etc.

But, the manufacturer may wish to promote the common theme of decorative indicia between the package and the product contained therein while, at the same time, providing indicia which promote a luxurious appearance or high quality image to the user. The consumer may desire matched, but not identical, indicia.

Certain indicia have become recognized in the art as being particularly consumer preferred for certain consumer products. For example, the embossed indicia illustrated by U.S. Pat. No. 5,874,156 issued to Schulz is found in bath tissue and has yielded recognition of such products. Such indicia comprise a wavy diamond pattern and signature embossments within the wavy diamonds.

Despite the commercial success of these indicia, to date, no attempt has been made in the art to use such indicia in packaging or to relate packaging and products contained therein through the use of such indicia. For example, the bath tissue embossments illustrated by the aforementioned Schulz '156 patent are visible on the tissue when the consumer looks through the transparent overwrap in which the tissue is packaged. However, a transparent overwrap is not suitable for certain other products, such as large packages of facial tissue, where a film overwrap is unfeasible for long-term dispensing of the product.

As used herein, two or more indicia are considered to be matched if the indicia are not identical and one of the indicia can be dissected into discrete, finite shapes which, without significant manipulation, such as gross deformation and preferably not rotation of different elements to different degrees, can be used to form the second or other indicium. Alternatively, two or more indicia are considered to be matched if the indicia comprise similar or identical elements organized in a different pattern or sequence.

Accordingly, there exists a need in the art for a package and product contained therein having matched indicia. There further exists a need in the art for matched indicia which promote a luxurious, high quality appearance to the user on both the package and the product contained therein.

BRIEF DESCRIPTION OF THE DRAWINGS

FIGS. 2A and 2B have 50% of the cells filled with decorative markings, and particularly 25% of the cells filled with a decorative marking comprising flowers and scallop-shaped decorative indicia matching the latticework of FIG. 1 and the latticework in which the markings are contained. FIGS. 2A and 2B also disclose empty cells. FIG. 2B further illustrates decorative markings having secondary indicia. FIG. 2C has 25% of the cells filled with decorative markings, the latticework of FIG. 2C being formed of discrete dots.

Figure 1:
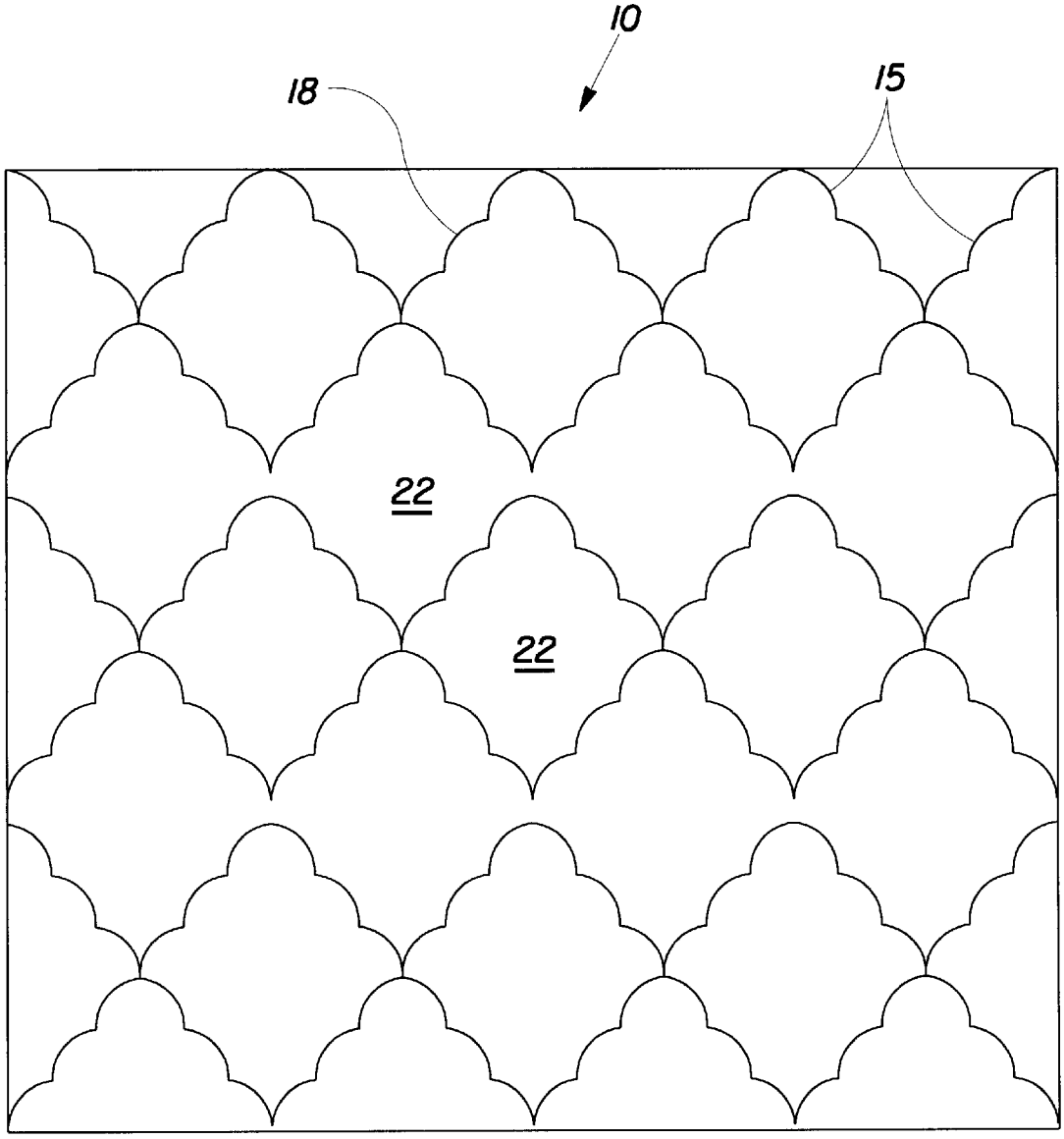
FIG. 1 is a top plan view of a first latticework according to the present invention. This first latticework comprises scallops.
Figure 2A:
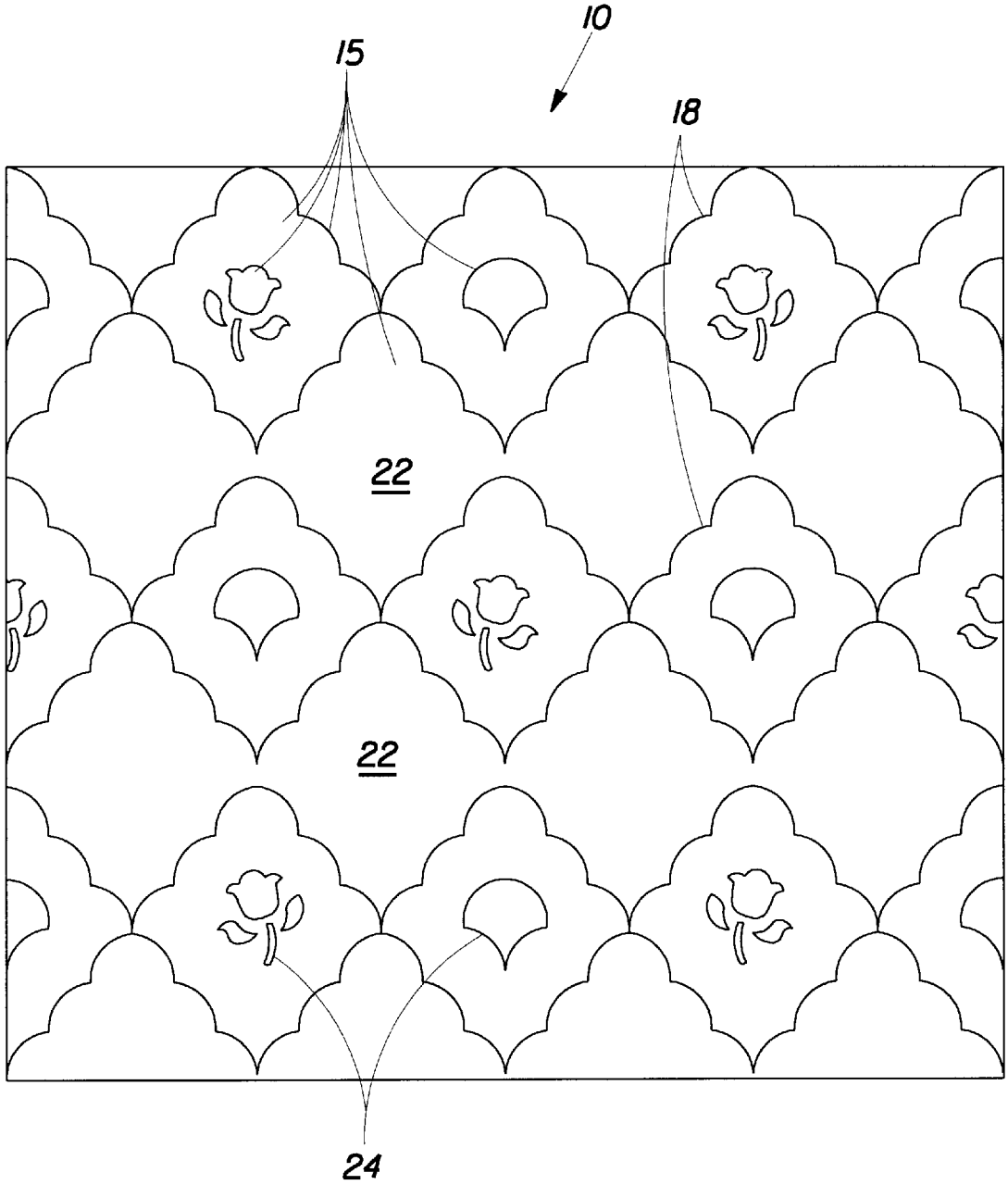
FIGS. 2A, 2B and 2C are top plan views of various second latticeworks matched to and derivable from the latticework of FIG. 1.
Figure 2B:
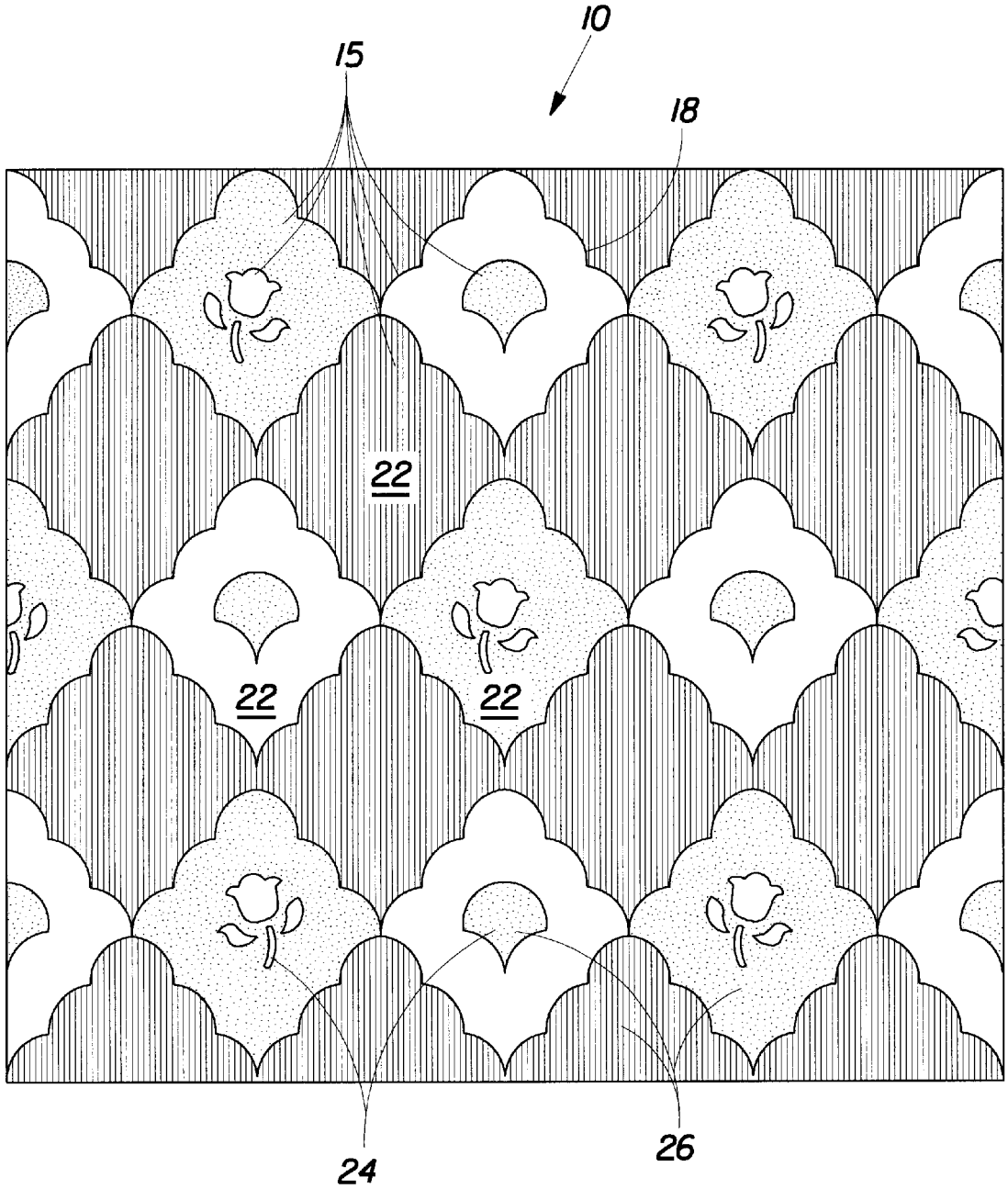
Figure 2C:
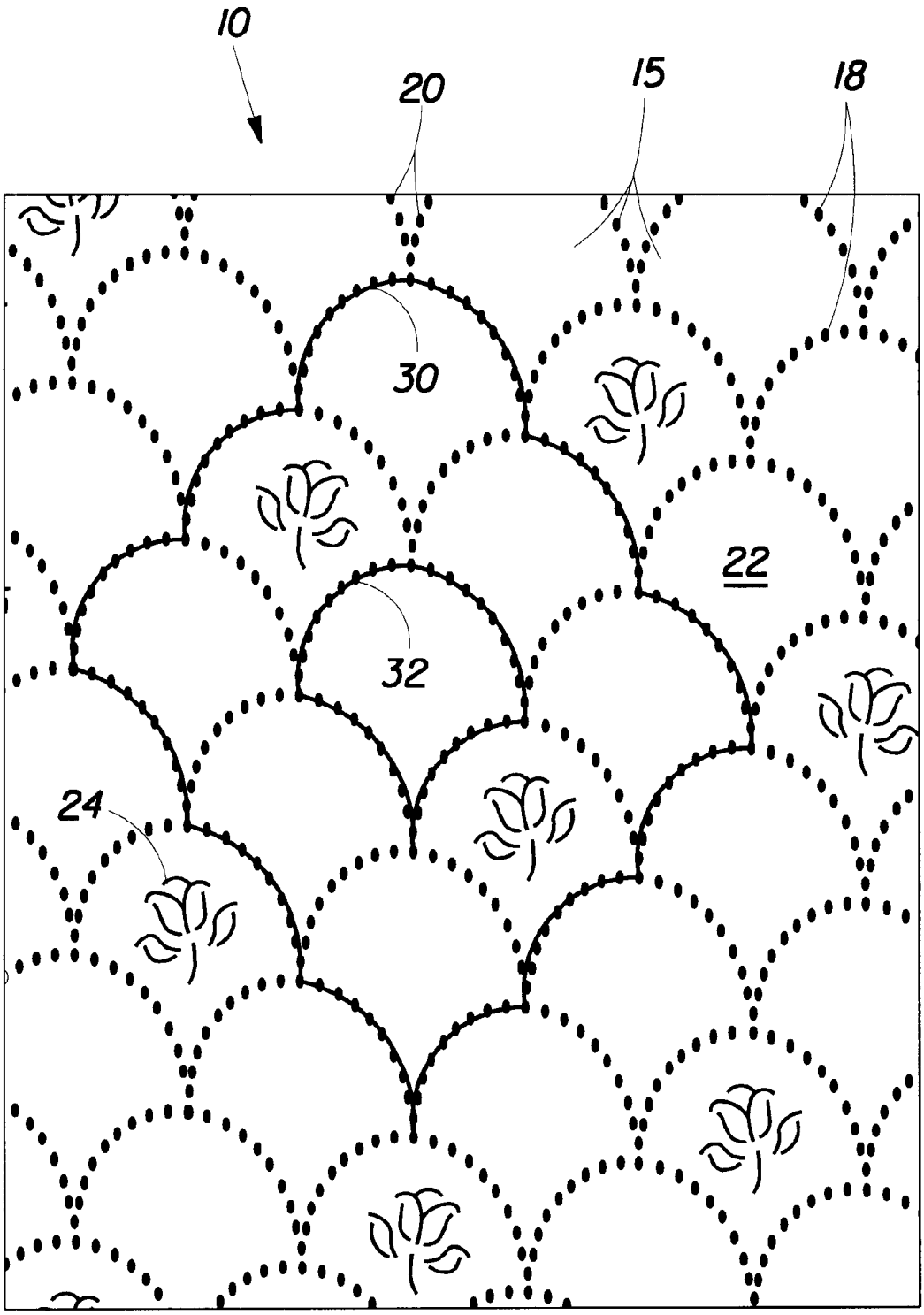

Note that three of the cells in FIG. 2C combine to form the shape of one cell in FIGS. 1–2B. An outline of three cells is shown in solid for illustrative purposes only. Further, a solid scallop shape in shown in FIG. 2C. The scallop shape forms one of the decorative indicia in FIGS. 2A–2B.

Figure 3A:
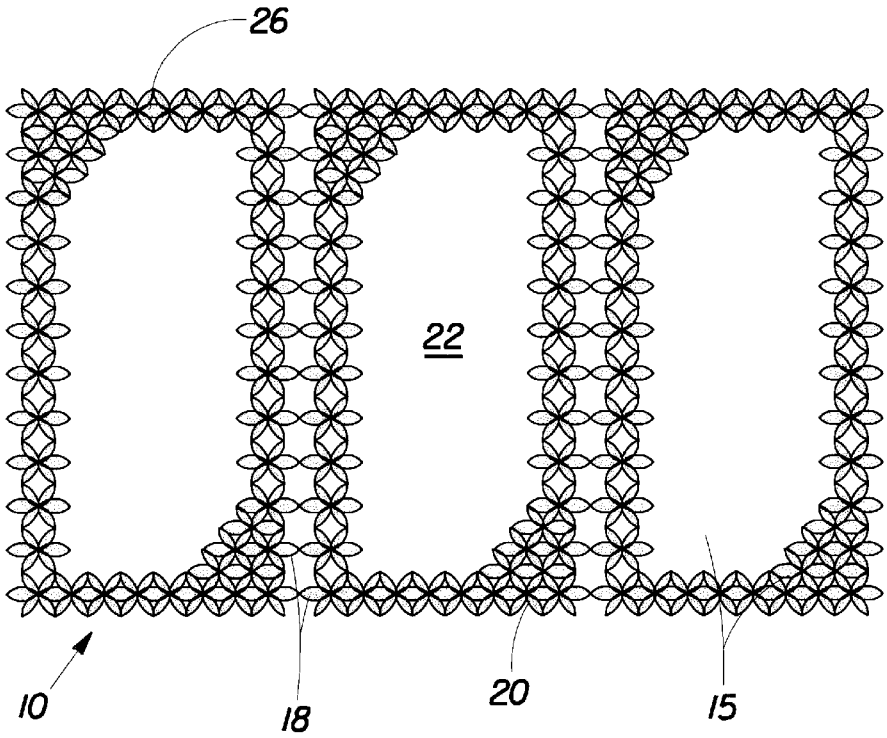
Figure 3B:
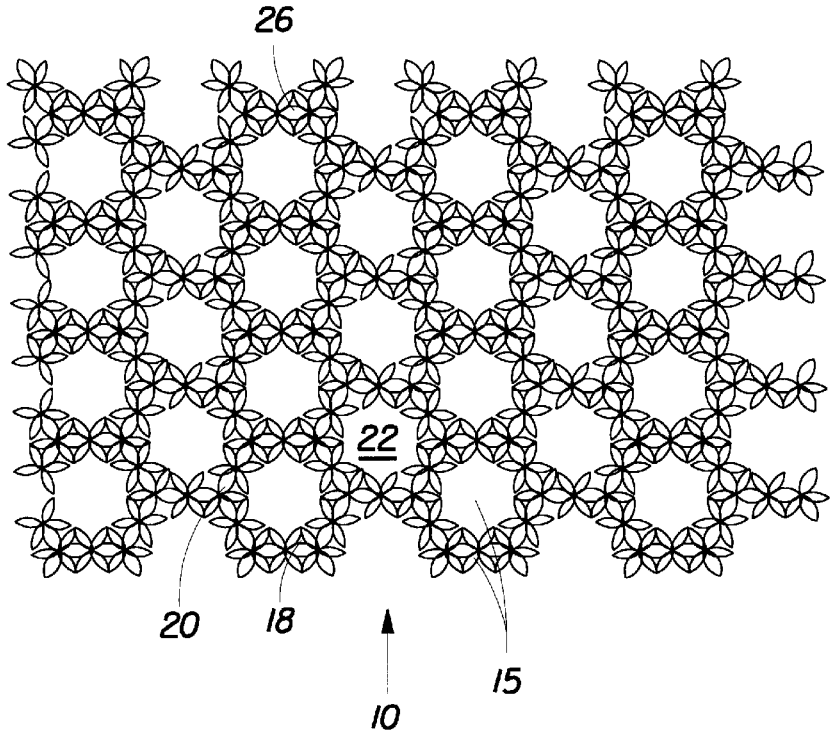

FIGS. 3A and 3B show illustrative first latticeworks, each comprising a rosette pattern.

Figure 3C:
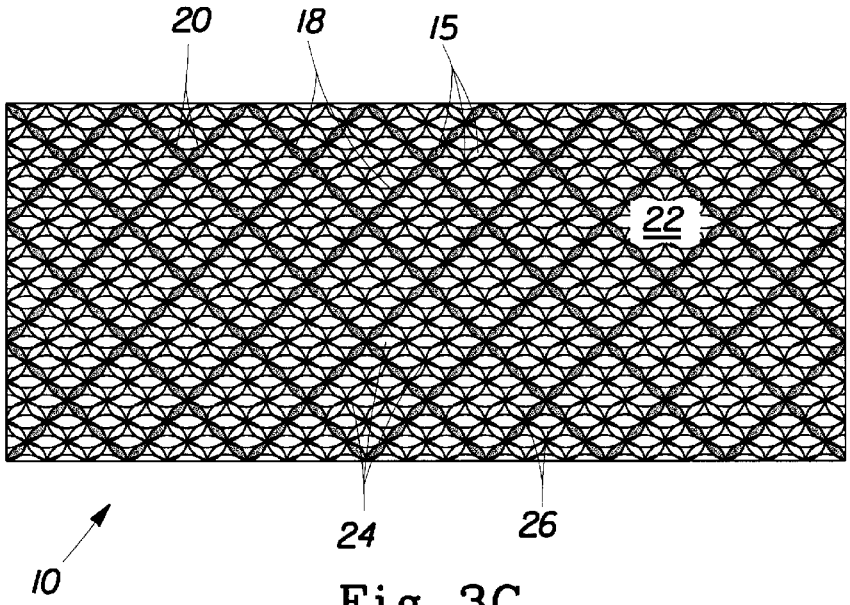
Figure 3D:
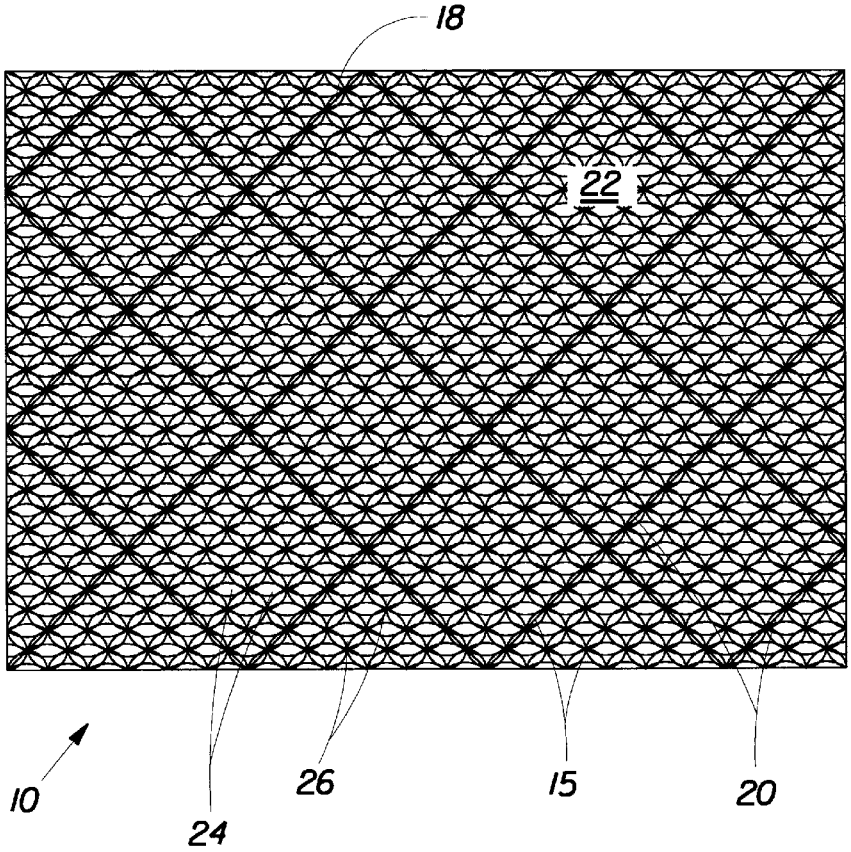

FIGS. 3C–3D show illustrative matched latticeworks, each having decorative markings derivable from and matched to the latticeworks of FIG. 3A and/or FIG. 3B.

Figure 4A:
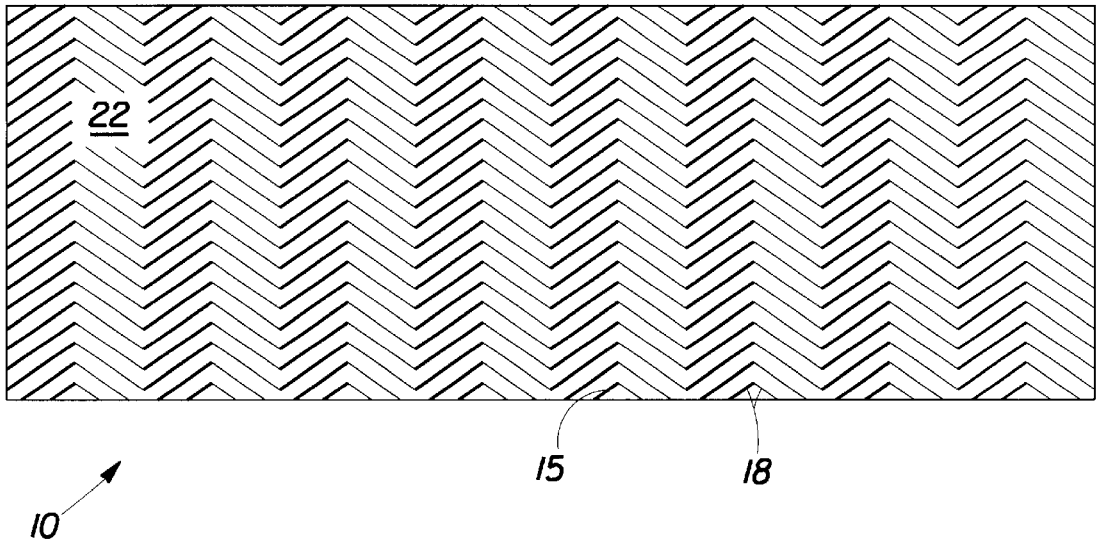
Figure 4B:
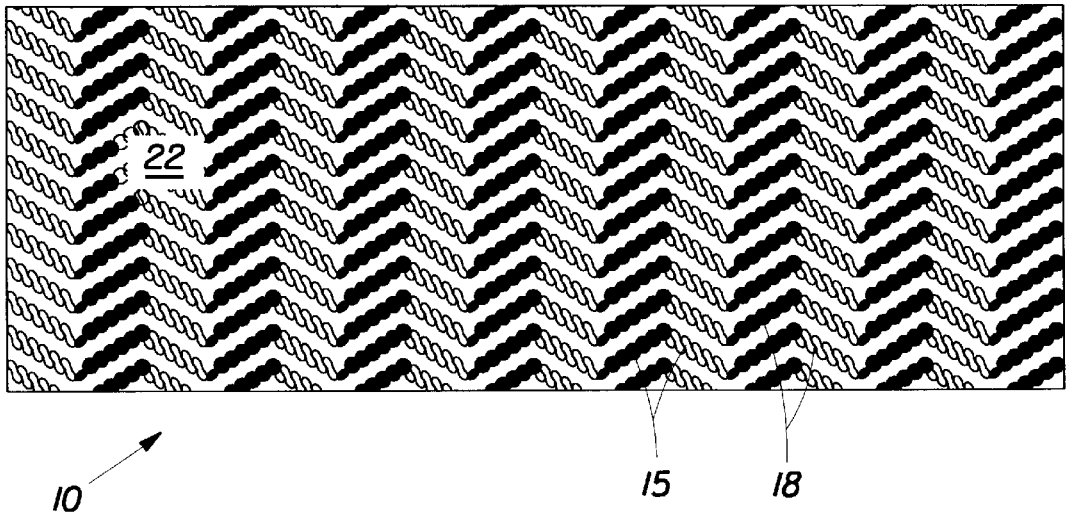
Figure 4C:
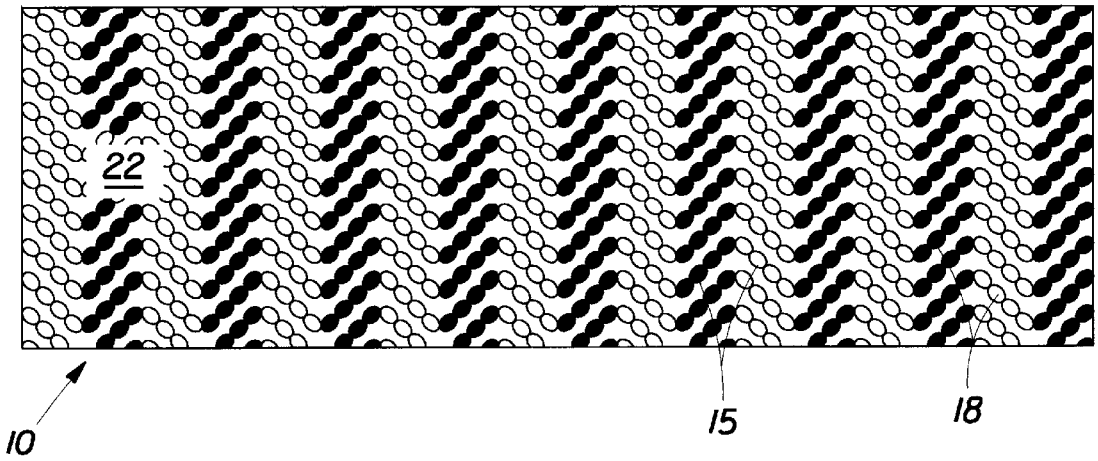
Figure 4D:
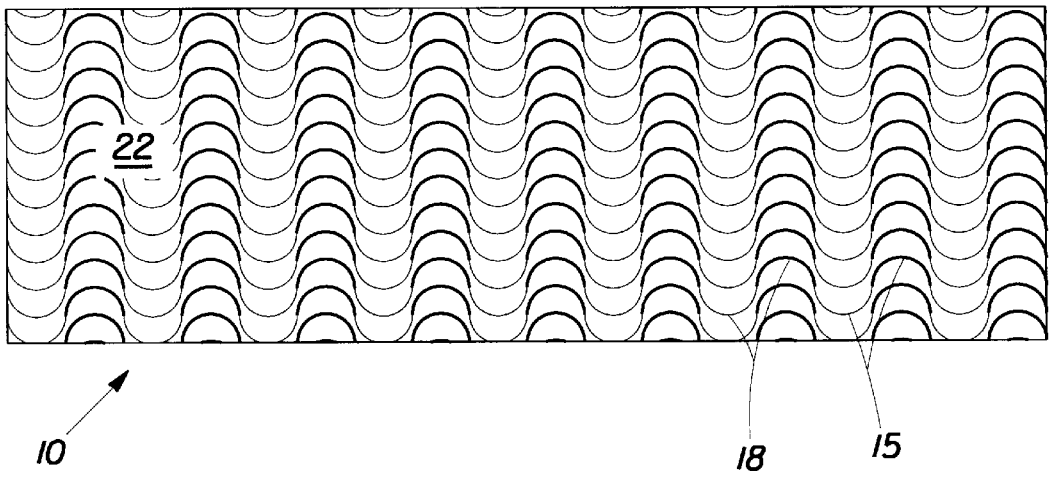
Figure 4E:
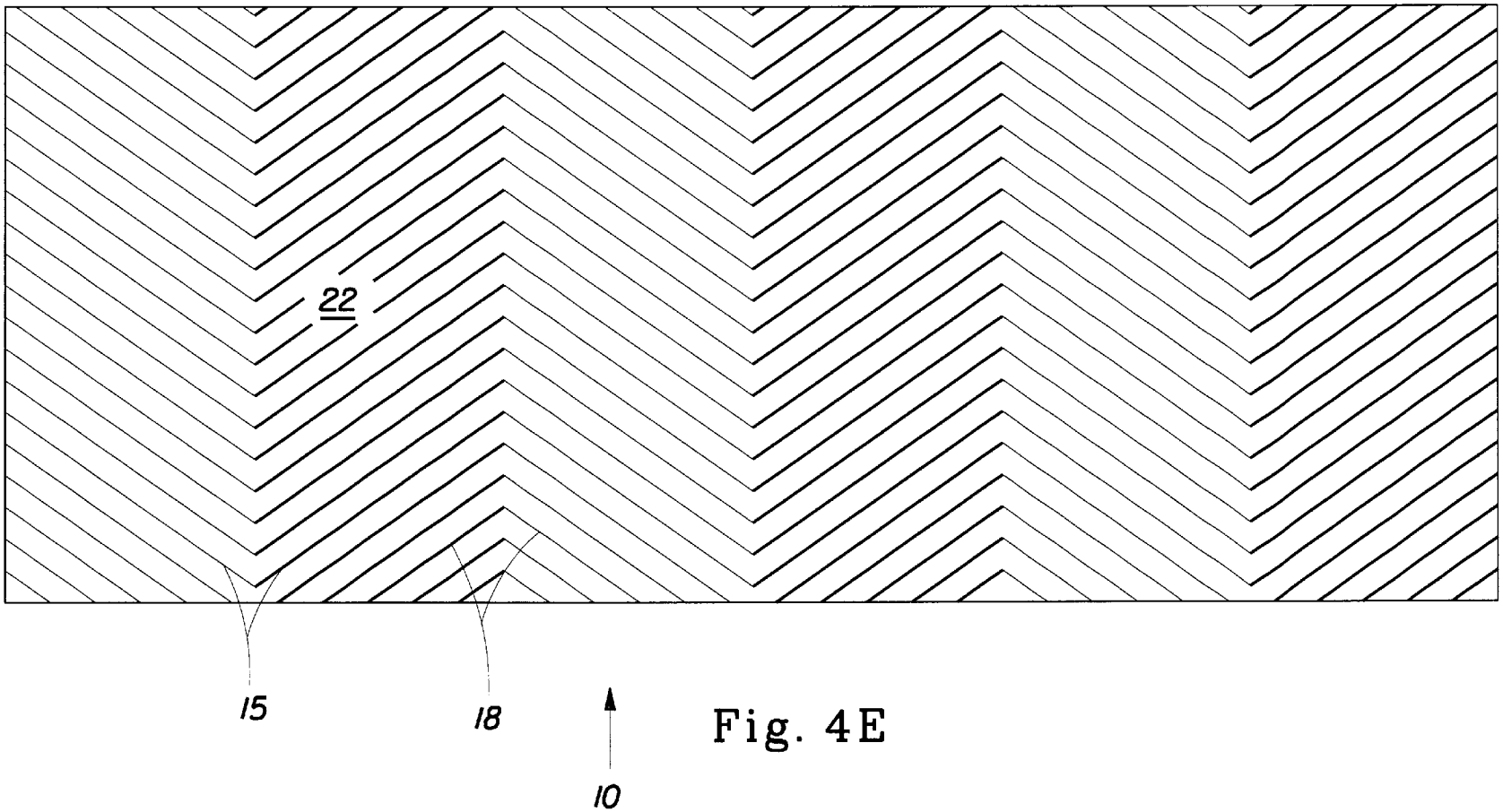

FIGS. 4A and 4E are top plan views of first latticeworks, each comprising a herringbone pattern.

FIGS. 4B, 4C and 4D are illustrative matched latticeworks, each derivable from and matched to the latticeworks of FIGS. 4A or 4E.

Figure 5A:
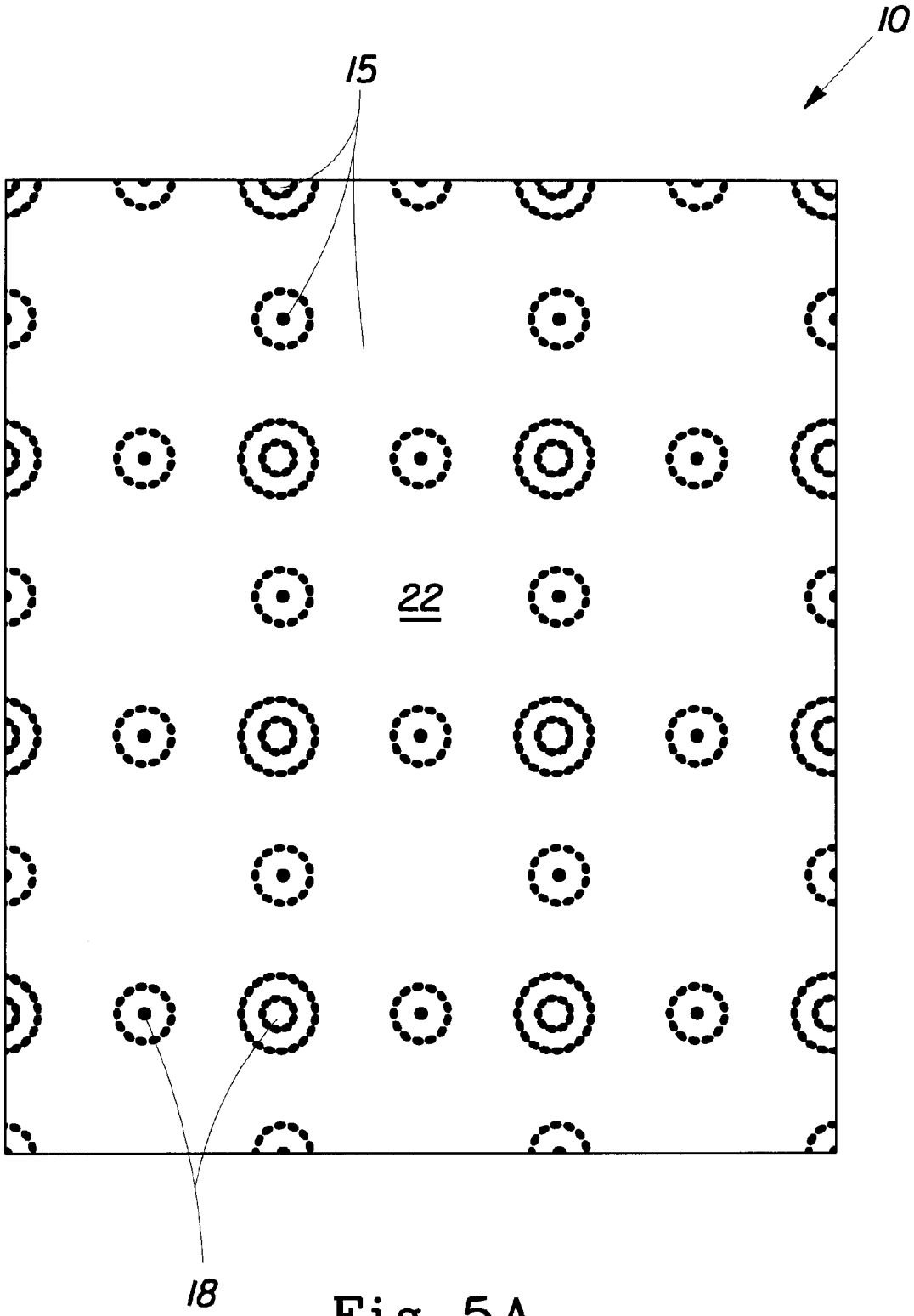

FIG. 5A is a latticework comprising circles formed from discrete dots.

Figure 5B:
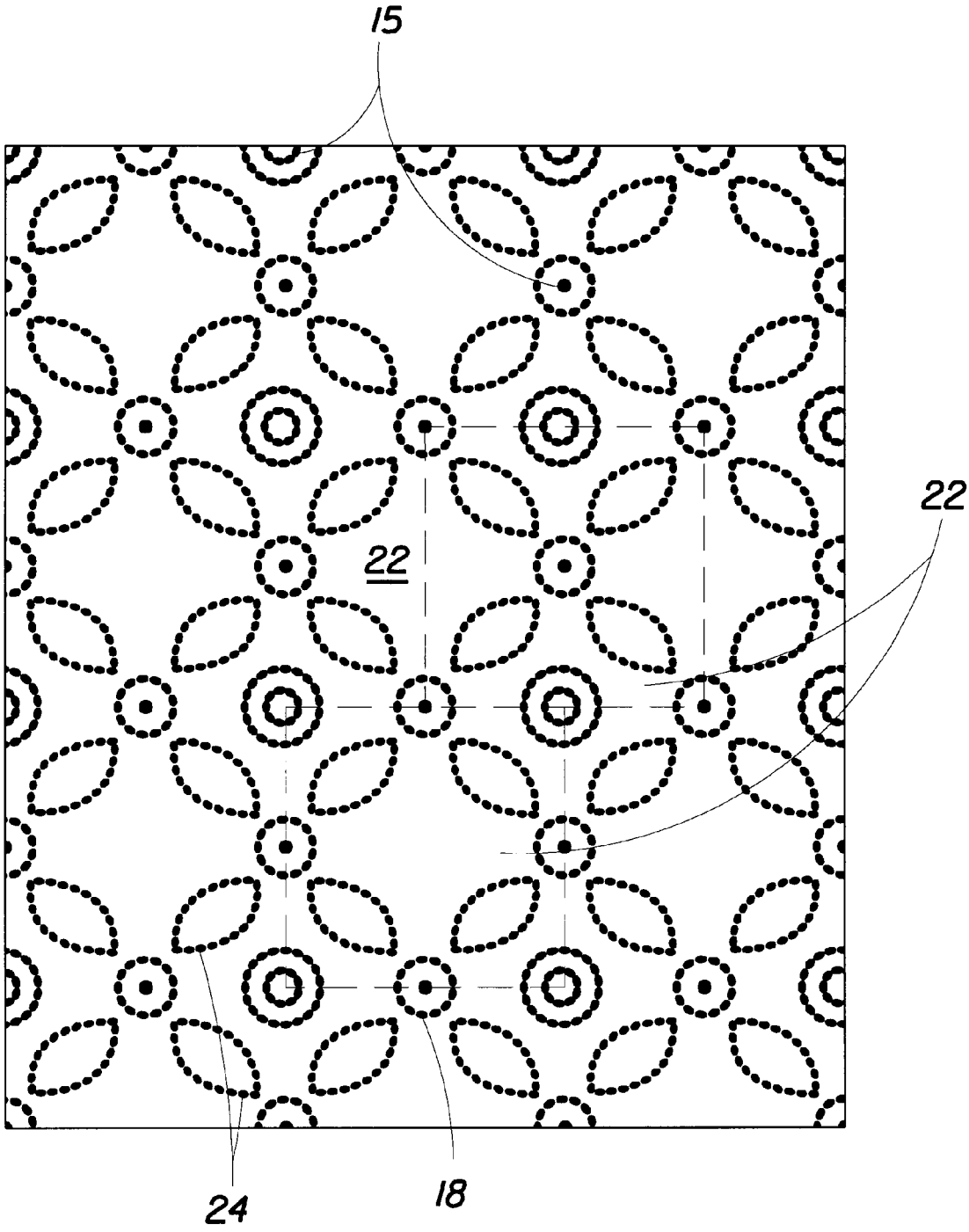
Figure 5C:
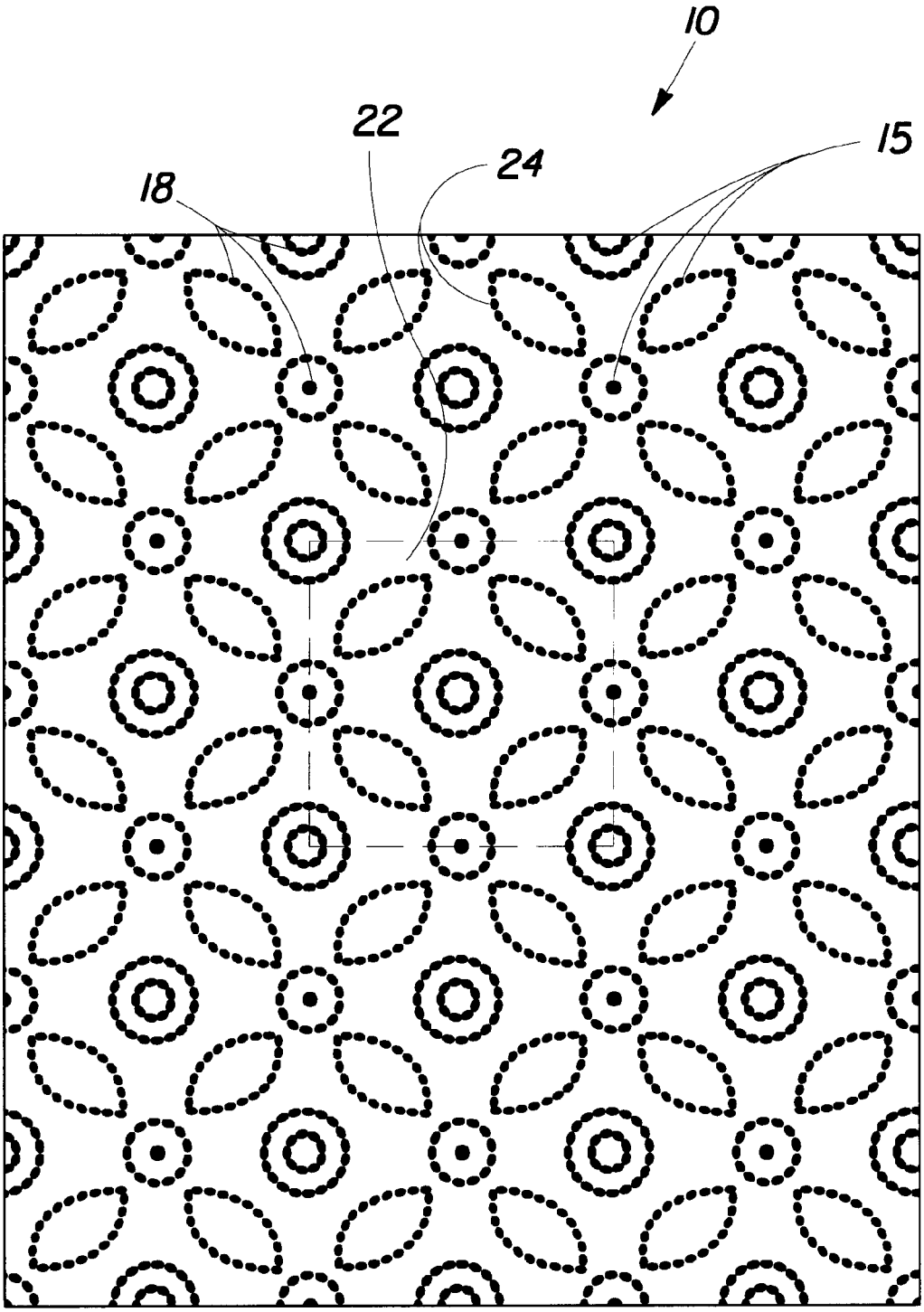

FIGS. 5B–5C are illustrative matched latticeworks, each derivable from and matched to the latticework of FIG. 5A. FIG. 5B illustrates three differently defined cells, each comprising a separate repeating unit. However, any of the three illustrated cells may be repeated to form the pattern of FIG. 5B. FIG. 5C, for example, illustrates plural latticeworks.

Figure 6A:
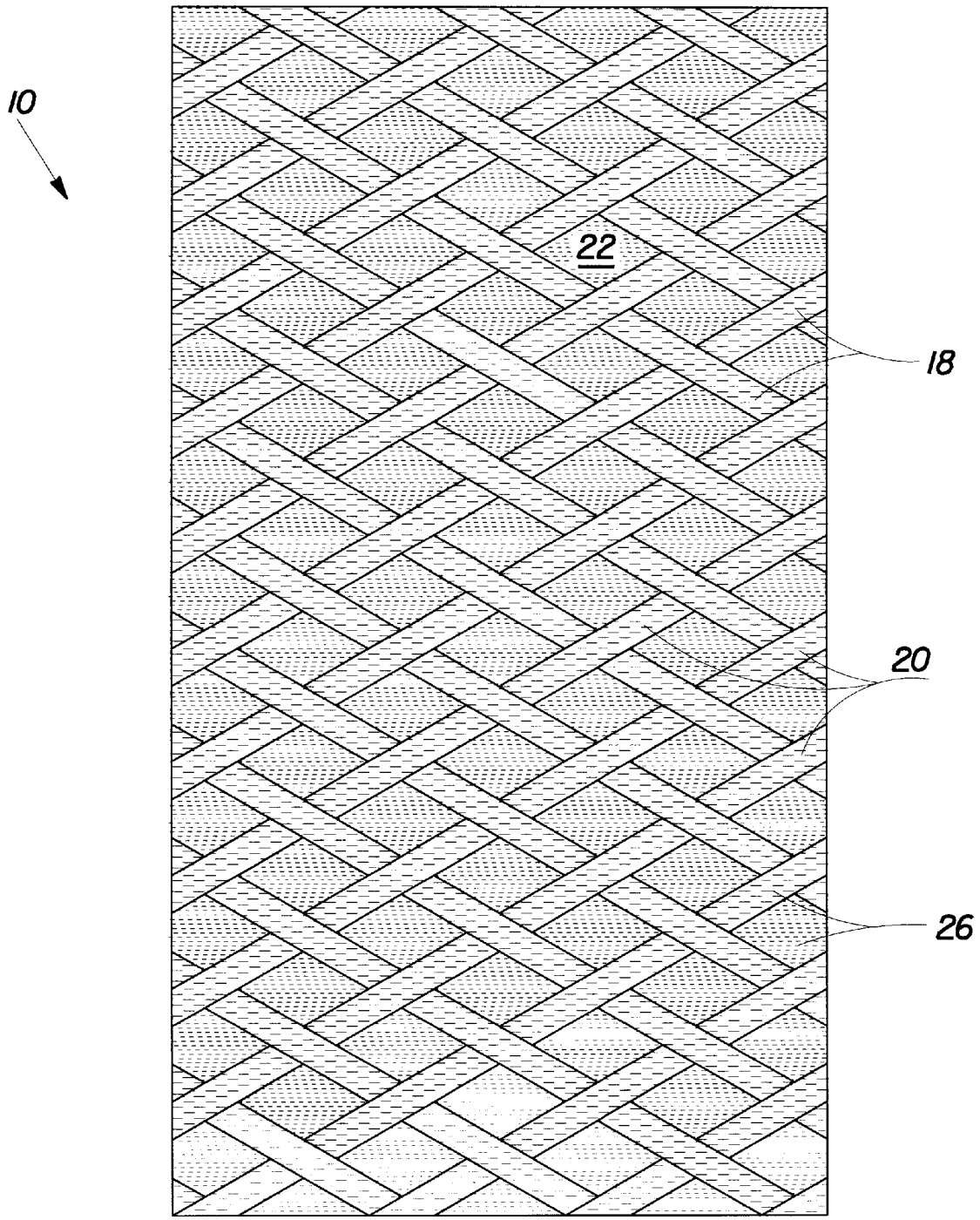

FIG. 6A is a top plan view of a first latticework comprising a braided diamond pattern.

Figure 6B:
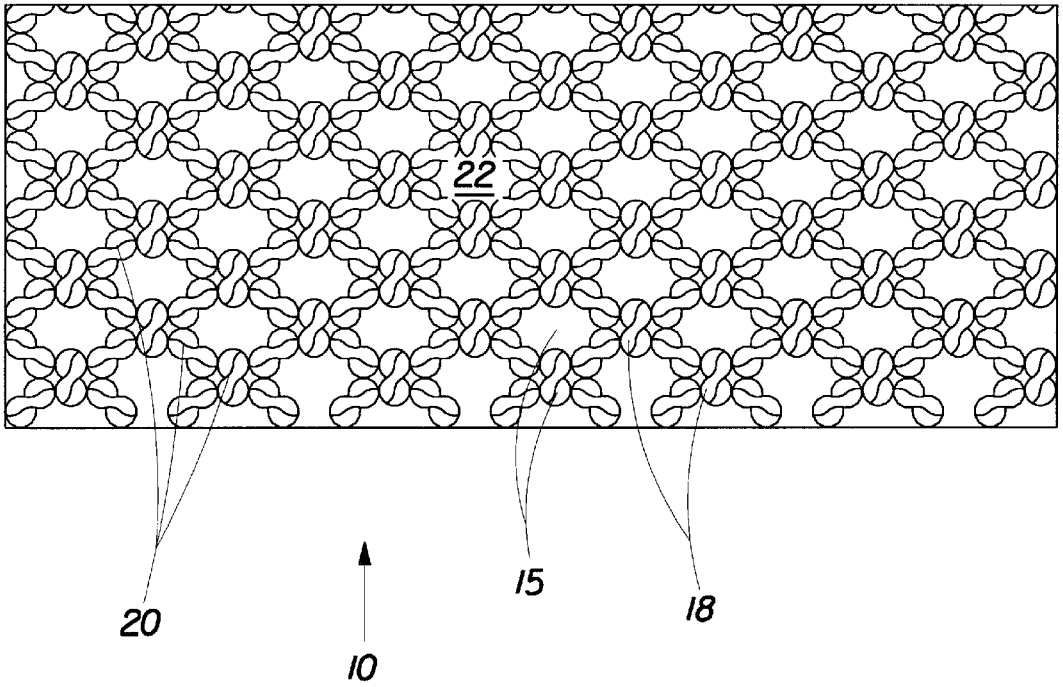
Figure 6C:
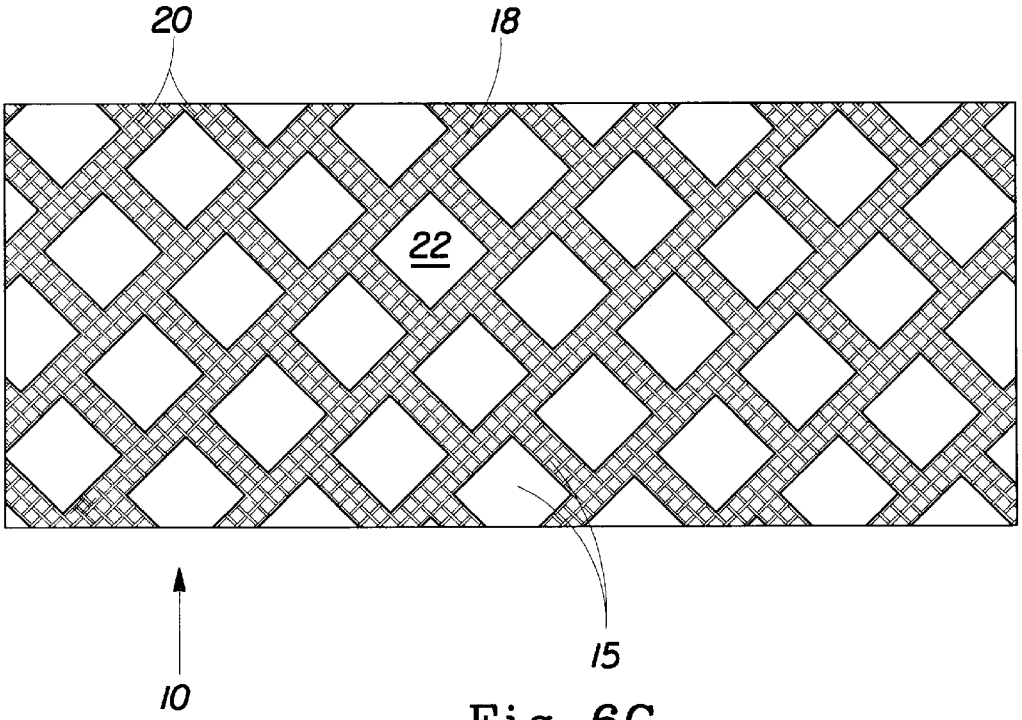

FIGS. 6B and 6C are illustrative matched latticeworks, each derivable from and matched to the latticework of FIG. 6A.

SUMMARY OF THE INVENTION

The invention comprises a package in combination with a disposable consumer product contained in and dispensable from the package. The consumer product may comprise a sheet good, such as facial tissue, paper toweling, bath tissue, napkins, etc.

The package has at least one external face with a first indicia disposed thereon. The disposable consumer product has a matched second indicia disposed directly thereon.

At least one of the first and/or second indicia comprise a latticework. The latticework defines cells, which may contain decorative markings. The decorative markings of the cells comprise shapes and aesthetically discernible features which correspond to and are derivable from the other latticework.

DETAILED DESCRIPTION OF THE INVENTION

The present invention comprises a package and consumer products disposed therein. The consumer products are dispensable from the package, typically through an opening. The opening may be disposed on one or more faces of the packaging.

The consumer products may be facial tissue, paper toweling, bath tissue, napkins, placemats, or other sheet goods as are know in the art. The sheet goods, or other consumer product, are typically disposable, but may be reusable. As used herein, a disposable consumer product is one in which is intended to be discarded after a single use and not cleaned or otherwise restored.

Examining the package in more detail, the package may be rigid or flaccid. If the package is flaccid, it may be made in accordance with commonly assigned PCT Application No. 98/38105 filed Feb. 28, 1997 in the names of Hill, et al.; U.S. Pat. No. 4,886,167 issued Dec. 12, 1989 to Dearwester; U.S. Pat. No. 5,027,582 issued Jul. 2, 1991 to Dearwester; U.S. Pat. No. 5,379,897 issued Jan. 10, 1995 to Muckenfuhs; U.S. Pat. No. 5,685,428 issued Nov. 11, 1997 to Herbers, et al.; U.S. Pat. No. 5,735,106 issued Apr. 7, 1998 to Burda, et al., which are incorporated herein by reference.

If a rigid package is desired, it may be made in accordance with commonly assigned PCT Application No. 98 18682 filed Oct. 29, 1996 in the name of Umanetz; U.S. Pat. No. 3,576,243 issued Apr. 27, 1971, to Truinck; U.S. Pat. No. 3,881,632 issued May 6, 1975 to Early, et al.; U.S. Pat. No. 4,231,491 issued Nov. 4, 1980 to Pierson, et al.; U.S. Pat. No. 4,197,964 issued Apr. 15, 1980 to Pryor; U.S. Pat. No. 4,623,074 issued Nov. 18, 1986 to Dearwester; U.S. Pat. No. 4,765,508 issued Aug. 23, 1988 to Poppe; U.S. Pat. No. 5,332,118 issued Jul. 26, 1994 to Muckenfuhs; U.S. Pat. No. 5,520,308 issued May 28, 1996 to Berg, et al.; U.S. Pat. No. 5,516,001 issued May 14, 1996 to Muckenfuhs, et al.; U.S. Pat. No. 5,535,887 issued Jul. 16, 1996 to Young, et al.; U.S. Pat. No. 5,618,008 issued Apr. 8, 1997 to Dearwester; U.S. Pat. No. 5,810,200 issued Sep. 22, 1998 to Trokhan; and PCT Application No. 98 29108 filed Dec. 30, 1996 in the names of Brewer, et al., which are incorporated herein by reference.

Referring to FIGS. 1–6C, with particular emphasis on FIGS. 1–2C if sheet goods are selected for the consumer product, the sheet goods may be fibrous. Particularly, the sheet goods may be cellulosic, synthetic, or a combination thereof. The sheet goods may be tissue 10 as is known in the art and described below. The tissue 10 may be wet laid or air laid as is known in the art. If the tissue 10 is wet laid, it may be through air dried or conventionally dried. The consumer product will be discussed below as a tissue 10, although it is to be understood that the invention described and claimed herein relates to other consumer products as well. The tissue 10 may be usable as a bath tissue, facial tissue, table napkin, paper toweling, placemat, etc.

If desired, the tissue 10 may be differential density and made according to any of commonly assigned U.S. Pat. No. 4,529,480, issued Jul. 16, 1985 to Trokhan; U.S. Pat. No. 4,637,859, issued Jan. 20, 1987 to Trokhan; U.S. Pat. No. 5,364,504, issued Nov. 15, 1994 to Smurkoski et al.; and U.S. Pat. No. 5,529,664, issued Jun. 25, 1996 to Trokhan et al., U.S. Pat. No. 5,679,222 issued Oct. 21, 1997 to Rasch et al., and U.S. Pat. No. 5,714,041 issued Feb. 3, 1998 to Ayers et al., which are incorporated herein by reference.

Alternatively, other through air drying processes are disclosed in the following U.S. patents which are suitable for use with tissues 10 in the present invention: U.S. Pat. No. 3,301,746, issued Jan. 31, 1967 to Sanford et al.; U.S. Pat. No. 3,905,863, issued Sep. 16, 1975 to Ayers; U.S. Pat. No. 3,974,025, issued Aug. 10, 1976 to Ayers; U.S. Pat. No. 4,191,609, issued Mar. 4, 1980 to Trokhan; U.S. Pat. No. 4,239,065, issued Dec. 16, 1980 to Trokhan; U.S. Pat. No. 5,366,785 issued Nov. 22, 1994 to Sawdai; and U.S. Pat. No. 5,520,778, issued May 28, 1996 to Sawdai, which are incorporated herein by reference.

If desired, the tissue 10 may be conventionally dried using a felt as is known in the art and described in the following references: U.S. Pat. No. 5,549,790, issued Aug. 27, 1996 to Phan; U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; and U.S. Pat. No. 5,861,082 issued Jan. 19, 1999 to Ampulski et al., which are incorporated herein by reference.

If desired, the tissue 10 may have multiple basis weight as described U.S. Pat. No. 5,245,025, issued Sep. 14, 1993 to Trokhan et al.; U.S. Pat. No. 5,527,428 issued Jun. 18, 1996 to Trokhan et al.; U.S. Pat. No. 5,534,326 issued Jul. 9, 1996 to Trokhan et al.; U.S. Pat. No. 5,654,076, issued Aug. 5, 1997 to Trokhan et al.; U.S. Pat. No. 5,820,730, issued Oct. 13, 1998 to Phan et al.; U.S. Pat. No. 5,277,761, issued Jan. 11, 1994 to Phan et al.; U.S. Pat. No. 5,443,691, issued Aug. 22, 1995 to Phan et al.; U.S. Pat. No. 5,804,036 issued Sep. 8, 1998 to Phan et al.; U.S. Pat. No. 5,503,715, issued Apr. 2, 1996 to Trokhan et al.; U.S. Pat. No. 5,614,061, issued Mar. 25, 1997 to Phan et al.; and U.S. Pat. No. 5,804,281 issued Sep. 8, 1998 to Phan et al., which are incorporated herein by reference.

Alternatively, the tissue 10 may be dried on a belt having a jacquard weave. Illustrative belts having a jacquard weave are found in U.S. Pat. No. 5,429,686 issued Jul. 4, 1995 to Chiu, et al., and U.S. Pat. No. 5,672,248 issued Sep. 30, 1997 to Wendt, et al.

If desired, the tissue 10 may be layered as is known in the art. Layered tissues 10 suitable for use in the present invention are disclosed in U.S. Pat. No. 3,994,771, issued Nov. 30, 1976 to Morgan, Jr. et al.; U.S. Pat. No. 4,225,382, issued Sep. 30, 1980 to Kearney et al.; and U.S. Pat. No. 4,300,981, issued Nov. 17, 1981 to Carstens, which are incorporated herein by reference.

The indicia 15 may be applied to the tissue 10 and/or the package by any means well known in the art, including printing. For example, lithographic, ink jet, gravure or flexographic printing may be utilized. If printing is selected as the means for applying the indicia 15, the printing apparatus may be constructed according to the teachings of commonly assigned U.S. Pat. No. 5,213,037 issued May 25, 1993 to Leopardi, II; U.S. Pat. No. 5,255,603 issued Oct. 26, 1993 Sonneville et al; and U.S. Pat. No. 5,802,974 issued Sep. 8, 1998 to McNeil, which are incorporated herein by reference.

Alternatively, the indicia 15 in the package and the tissue 10 may be embossed. Embossed tissue 10 may be performed using a dual-ply laminate system, as disclosed in commonly assigned U.S. Pat. No. 5,294,475 issued Jun. 12, 1992 to McNeil; U.S. Pat. No. 5,486,323 issued Nov. 21, 1995 to McNeil, which patents are incorporated herein by reference.

Alternatively, the embossing may be performed by the knob-to-knob process disclosed in commonly assigned U.S. Pat. No. 3,414,459 issued Dec. 3, 1968 to Wells, which patent is incorporated herein by reference. Alternatively, the embossing may be performed using a nested process as disclosed in U.S. Pat. No. 3,547,723 issued Dec. 15, 1970 to Gresham; U.S. Pat. No. 3,556,907 issued Jan. 19, 1971 to Nystrand; U.S. Pat. No. 3,708,366 issued Jan. 2, 1973 to Donnelly; U.S. Pat. No. 3,738,905 issued Jun. 12, 1973 to Thomas; and U.S. Pat. No. 3,867,225 issued Feb. 18, 1975 to Nystrand, which patents are incorporated herein by reference. Alternatively, the indicia 15 may be formed by imprinting to have the different opacity or different density as described in the aforementioned and incorporated differential density patents incorporated by reference hereinabove. Further, different basis weights may yield different intensive properties which are visible to the consumer. The indicia 15 may be formed by having regions in the paper of differing basis weights and, or, hence, different opacities. Different basis weights may be formed by the aforementioned multiple basis weight patents incorporated hereinabove.

Alternatively, either or both of the first and second indicia 15 may comprise combinations of the foregoing. For example, one indicia 15 may be embossed, while the other may be printed or imprinted. Further, either indicia 15 may be formed by a combination of embossing, printing and imprinting.

Examining the indicia 15 in more detail, the indicia 15 preferably comprise first and second latticeworks 18. One of the latticeworks 18 is disposed on the external face of the package. The other latticework 18 is disposed on the consumer product. As used herein, a latticework 18 defines an essentially continuous network 20 extensible, and preferably extending, substantially throughout the surface on which it is disposed. The latticework 18 may be comprised of rectilinear line segments, curvilinear line segments, or a combination thereof. The latticework 18 may resemble a matrix or a gridwork of diamonds, squares, circles or any other polygon or irregular shape desired by the user. Alternatively, the latticework 18 may comprise a herringbone pattern.

The latticework 18 preferably defines an array of closed cells 22. The cells 22 may be regularly and uniformly sized and spaced, as shown. Alternatively, the cells 22 may comprise a plurality of sizes and shapes.

Disposed in one or more of the individual cells 22 of either or both latticeworks 18 may be decorative markings 24. The decorative markings 24 may be nonalphameric. By nonalphameric, it is meant that the decorative markings 24 do not consist of the recognizable alphabetic characters A–Z (upper or lower case), the Arabic numerals 0–9, or foreign translations thereof. The decorative markings 24 may be arbitrary. By arbitrary, it is meant that the decorative markings 24 are nonalphameric and further do not comprise known, recognizable shapes such as flowers, butterflies, hearts, birds, pumpkins, cornstalks or other everyday objects. Instead, an arbitrary shape is comprised of lines forming an abstract having no other defined meaning.

The first indicia and second indicia 15 are not identical. That is to say the indicia 15 disposed on the tissue 10 and the indicia 15 disposed on the packaging are not the same. The first and second indicia 15 may have different latticeworks 18, different decorative markings 24, different secondary indicia 26, or various combinations thereof. By properly selecting the aesthetic relationship between the first and second indicia 15, the first and second indicia 15 may be corresponding as described hereinbelow, so that the first and second indicia 15 aesthetically correspond to each other.

The first and second latticeworks 18 may be related as follows. The first and second latticeworks 18 comprise individual cells 22. At least some of the cells 22 of at least one latticework 18 have decorative markings 24 therein. The decorative markings 24 of that (e.g., first) latticework 18 correspond to the individual cells 22 of the other (e.g., second) latticework 18. The individual cells 22 of one latticework 18 and the decorative markings 24 of the other latticework 18 may be congruent and differently sized.

For example, with particular reference to FIG. 2C and FIGS. 1, 2A and 2B, it is seen that the latticework 18 of FIG. 2C comprises a grid of individual scallops forming an essentially continuous network 20. However, as shown by the 3×3 array 30 of outlined scallops, plural elements of the latticework 18 of a first indicia 15 may be combined to form an individual cell 22 and a different latticework 18 of a second indicia 15.

Furthermore, a single scallop 32 of the first indicia 15 may be used as a decorative marking 24 in the second indicia 15.

The decorative markings 24 of a latticework 18 and individual cells 22 are said to be matched if, as described above, portions of one latticework 18 or cell 22 can be dissected and used to form the other without significant manipulation, such as gross deformation, and preferably not rotation, as described above.

Overall enlargement or reduction in the size of the indicia 15 will not, alone, be considered in the determination of whether or not two, or more, indicia 15 are matched. Furthermore, with particular reference to FIGS. 5A–5C, it is to be recognized that discrete dots may be manipulated, to form any desired indicium 15. Reorganization and manipulation of discrete dots and individual line segments is not considered in determining whether or not two, or more, indicia 15 are matched. Instead, one must look at the overall appearance of the individual elements such as the cells 22 and the decorative markings 24 forming the indicia 15.

An alternative, although not necessarily preferred, method of determining whether or not first and second indicia 15 are matched is to ascertain the number of steps needed to convert the first indicia 15 into the second indicia 15, or vice versa. Preferably, either the first or second indicia 15 may be converted to the other indicia 15 in a process requiring, manipulation of four or fewer, preferably three or fewer, and, most preferably, two discrete steps or operations. Each step or operation is assumed to occur over the entire field of the indicia 15. A step includes dissecting, combining, rearranging, rotating, deleting, adding, inverting, enlargement or reduction of specific elements (but not enlargement or reduction of the overall indicia 15), substitution of elements, changing colors, increasing or decreasing line widths, substitutions of form (i.e., braided 4, twisted 4, woven 4, etc.)

Of course, it is to be recognized, that multiple decorative markings 24 may be employed in one or both of the first and second latticeworks 18. For example, the first latticework 18 may have a plurality, such as two or more, decorative markings 24 disposed in the cells 22. A plurality of decorative markings 24 may be advantageously disposed within the cells 22 if a pattern having all cells 22 containing a decorative marking 24 is selected. If only one decorative marking 24 is selected, 10% to 100%, and preferably 25% to 75%, of the cells 22 may contain such decorative markings 24.

The plurality of decorative markings 24 mentioned in the preceding paragraph are presumed to be disposed at a frequency of not more than one per cell 22, i.e., plural decorative markings 24 may be selected and used. However, it is presumed that each different decorative marking 24 will occupy its own cell 22. However, if desired, plural decorative markings 24 may be disposed within the same cell 22. The plural decorative markings 24 may be alike or different.

Preferably, only one of the decorative markings 24 is utilized to form the second latticework 18. If multiple indicia 15 are used to form the latticework 18, the latticework 18 can become unwieldy in its complexity and, potentially, less aesthetically pleasing.

Further, empty cells 22 may be disposed throughout either or both latticeworks 18. If desired, one of the latticeworks 18 may comprise all empty cells 22. As used herein, a cell 22 is considered to be empty if it does not have a decorative marking 24 therein. Alternatively, either or both latticeworks 18 may have some decorative markings 24 contained in the individual cells 22, without all of the cells 22 being filled. Alternatively, either or both latticeworks 18 may have all cells 22 filled with the decorative markings 24.

Referring to FIGS. 3A–3D, a latticework 18 and decorative markings 24 made of a rosette pattern are shown. FIGS. 3A–3B show two different latticeworks 18 made of a rosette pattern. The cells 22 of FIGS. 3A–3B are each six-sided on the interior, with the cells 22 of FIG. 3B comprising a regular polygon. The cells 22 of FIG. 3A comprise an irregular hexagon on the inside, and a rectangle on the outside. FIGS. 3C–3D show illustrative and non-limiting matched diamond-shaped cells 22 having the rosettes which made up the first latticeworks 18 of FIGS. 3A–3B. The rosettes are disposed internal to the diamond-shaped latticeworks 18 of FIGS. 3C–3D and comprise the decorative markings 24 within each diamond-shaped cell 22. FIGS. 3C–3D differ in the number of rosettes contained within each cell 22.

Referring to FIG. 4A, a herringbone-type latticework 18 is shown. FIG. 4A comprises a herringbone pattern with each cell 22 being comprised of a heavy line and a light line disposed in acute angular relationship to each other. Each chevron of the herringbone may be considered to comprise one cell 22 of the latticework 18. The basic herringbone pattern is the first indicia 15 in FIG. 4A.

FIG. 4E is matched to both FIG. 4A and FIGS. 4B–4D. FIG. 4E is similar to FIG. 4A as illustrating a basic herringbone-type latticework 18. However, like FIG. 4A, FIG. 4B illustrates a herringbone comprising alternating light and heavy lines. However, the line width of the heavy portion of FIG. 4E is much different (less than) the line width of the heavy portion of FIG. 4A. Further, the ratios of the line thickness to pitch and the ratios of the cell 22 length to cell 22 pitch are different in FIGS. 4A and 4E.

Matched second indicia 15 are shown in FIGS. 4B–4D. Note that FIGS. 4B–4D retain, as an illustrative example of matched indicia 15, cells 22 optionally having and comprising one heavy line and one light line. FIGS. 4B–4C retain the overall rectilinear herringbone ornamental appearance, while utilizing curvilinear elements for each cell 22 of the latticework 18. FIG. 4D utilizes curvilinear cells 22.

Referring to FIGS. 5A–5C, the latticework 18 and decorative markings 24 are made of a discrete dot pattern. The pattern of FIGS. 5B–5C resemble flowers. Each repeating unit of the latticeworks 18 of 5B and 5C may be considered to comprise the square or diamond made of either of the two types of circles shown, each having four oval-shaped petals of the flower within that repeating unit. FIGS. 5B–5C differ from each other in that FIG. 5C comprises no empty cells 22, whereas FIG. 5B comprises 50% empty cells 22. In contrast, each cell 22 of FIG. 5A is empty. Note that as one traverses a straight line in each of FIGS. 5A–5C, every other circle making up the line has a single dot or inner concentric circle within the outer circle.

Referring to FIGS. 6A–6C, FIG. 6A illustrates a first latticework 18 made of a woven braided pattem. Each braid of the latticework 18 comprises a single width between the individual cells 22 and is woven such that each braid traverses two cells 22 before being interwoven with another braid. The cells 22 are diamond-shaped. FIG. 6B comprises a braided pattern having braids which appear to be twisted and, like FIG. 6A, has a single braid between adjacent diamond-shaped cells 22. The braids of FIG. 6B do not appear to be interwoven. FIG. 6C shows a latticework 18 made of a braided pattern having a width of three braids between adjacent square cells 22. Like FIG. 6A, the braids are interwoven without being twisted.

Referring back to FIG. 2B, if desired, the latticework 18 and/or decorative markings 24 contained within the cells 22 may further comprise secondary indicia 26. A secondary indicium 26 does not change the overall aesthetic or ornamental appearance of a cell 22, decorative marking 24 or latticework 18 by modification to the shape or geometry of the same. Instead, the secondary indicium 26 further distinguishes that decorative marking 24 or individual cell 22 from other, like portions of the matched indicia 15. For example, a cell 22 or decorative marking 24 may be stippled, shaded, relieved, embossed to a different depth, be of a different color or otherwise distinguishable by the secondary indicia 26. Thus, decorative markings 24 may be distinguishable from an empty cell 22 or an empty portion of a cell 22 in two ways. First, the outline, or solid shape, of the decorative indicia 15 provides a first aesthetic distinction. Second, the secondary indicia 26 of the decorative markings 24 may be provided within the same overall aesthetic shape and appearance of that indicia 15 described above.

Furthermore, empty cells 22 may likewise be secondarily distinguished from cells 22 having a secondary indicia 26. Secondary indicia 26 for empty cells 22 may include the stippling, shading, relieving, embossing to a different depth, or other distinctions which do not detract from or change the shape, outline or other aesthetic features of those cells 22. Additionally, the empty cells 22 and/or decorative markings 24 may have provided a different color than the rest of the pattern.

Of course, it is to be recognized that a plurality of corresponding indicia 15 may be utilized with the consumer products and packaging of the present invention. For example, differing tissues 10 within the package may have different corresponding indicia 15. The indicia 15 may correspond to those of other tissues 10 in the package as well as correspond to indicia 15 on the package itself. Furthermore, many consumer products are sold in multiple packages. An outer package may have a first indicia 15 and an inner package may have a second indicia 15 while the consumer products have third, and possibly more, indicia 15. All of these indicia 15 may be made to aesthetically correspond as well.

Various embodiments and/or individual features of the invention are disclosed. All combinations and permutations of such embodiments and features are possible and can result in preferred executions of the invention.

What is claimed is:

1. A package in combination with a disposable consumer product contained therein, said package having at least one external face with first indicia disposed thereon, said disposable consumer product being contained within said package and dispensable therefrom, said disposable consumer product having second indicia non-identically matching said first indicia and disposed directly on said consumer product, at least one of said first and said second indicia comprising a latticework defined by individual cells, said individual cells having decorative markings therein.

2. The package and consumer product according to claim 1 wherein said latticework comprises a plurality of cells having decorative markings therein, said decorative markings being nonalphameric.

3. The package and consumer product according to claim 2 wherein said decorative markings are comprised of lines forming an abstract.

4. A package in combination with tissues contained therein, said tissues being dispensable from said package, said package having at least one external face with indicia thereon, said tissues having indicia thereon, one of said package and said tissues having a first latticework defined by individual cells, the other of, said package and said tissues having a second latticework defined by individual cells, at least some of said cells of said second latticework having decorative markings therein, said decorative markings matched to the individual cells of said first latticework.

5. The package and tissues according to claim 4 wherein said decorative markings are nonalphameric.

6. The package and tissues according to claim 4 wherein said decorative markings are comprised of lines forming an abstract.

7. The package according to claim 4 wherein said cells of said second latticework comprise a plurality of decorative markings.

8. The package and tissues according to claim 7 wherein said pluralities of decorative markings are disposed in an alternating patter.

9. The package and tissues according to claim 8 wherein said decorative markings further comprise secondary indicia which do not change the shape of said decorative markings.

10. The package and tissues according to claim 8 comprising empty cells in said second latticework.

11. A package and tissues according to claim 4, wherein said individual cells comprise a pattern made of rosettes.

12. A package and tissues according to claim 4, wherein said individual cells comprise a pattern made of scallops.

13. A package containing tissues therein, said tissues being dispensable from said package, said package having at least one external face, said external face of said package having indicia with a first latticework disposed thereon, said tissues having indicia comprising a second latticework, one of said first latticework and said second latticework containing decorative markings therein, said decorative markings of one said latticework being non-identically matched to individual cells of the other said latticework, at least one of said first latticework and said second latticework comprising individual cells having a shape derivable from said decorative marking.

14. A package and tissues according to claim 13, wherein less than all cells of said first latticework contain said decorative markings.

15. A package and tissues according to claim 14, wherein 25% to 75% of said cells contain said decorative markings.

16. A package and tissues according to claim 15, comprising two decorative markings within said first latticework.

17. A package and tissues according to claim 14, wherein both said latticeworks comprise decorative markings therein.

18. A package and tissues according to claim 17, wherein said decorative markings of said first latticework match said decorative markings of said second latticework.

* * * * *

UNITED STATES PATENT AND TRADEMARK OFFICE

CERTIFICATE OF CORRECTION

PATENT NO. : 6,520,330 B1
DATED : February 18, 2003
INVENTOR(S) : Anjana Batra

It is certified that error appears in the above-identified patent and that said Letters Patent is hereby corrected as shown below:

Column 8,
Line 9, “pattem” should read -- pattern --.

Column 9,
Line 39, “patter” should read -- pattern --.

Signed and Sealed this

Twenty-second Day of July, 2003

JAMES E. ROGAN
*Director of the United States Patent and Trademark Office*